US009713394B1

(12) United States Patent
Bruegmann

(10) Patent No.: US 9,713,394 B1
(45) Date of Patent: Jul. 25, 2017

(54) MODULAR RETAIL PRODUCT DISPLAY UNIT WITH IMPROVED PUSHER

(71) Applicant: Bruegmann USA, Inc., Houston, TX (US)

(72) Inventor: Malte Bruegmann, Houston, TX (US)

(73) Assignee: Brugemann USA, Inc., Houston, TX (US)

( * ) Notice: Subject to any disclaimer, the term of this patent is extended or adjusted under 35 U.S.C. 154(b) by 0 days.

(21) Appl. No.: 15/013,367

(22) Filed: Feb. 2, 2016

(51) Int. Cl.
*A47F 1/12* (2006.01)
*A47F 5/00* (2006.01)
*A47F 1/04* (2006.01)

(52) U.S. Cl.
CPC ..... *A47F 1/126* (2013.01); *A47F 1/04* (2013.01); *A47F 1/12* (2013.01); *A47F 1/125* (2013.01); *A47F 5/005* (2013.01)

(58) Field of Classification Search
CPC .. A47F 1/125; A47F 1/126; A47F 1/04; A47F 1/12; A47F 5/005; A47F 7/00; A47F 1/00
See application file for complete search history.

(56) References Cited

U.S. PATENT DOCUMENTS 7,703,614 B2 * 4/2010 Schneider ..... A47F 3/14 211/184
8,016,128 B2 * 9/2011 Valiulis ..... A47F 1/126 211/59.3
8,443,988 B2 * 5/2013 Niederhuefner ..... G08B 13/14 211/183
8,453,851 B2 * 6/2013 Ciesick ..... A47F 1/04 211/126.15
8,720,702 B2 * 5/2014 Nagel ..... A47B 96/027 211/193
8,893,901 B2 * 11/2014 Nagel ..... A47B 96/027 211/184
9,038,833 B2 * 5/2015 Ciesick ..... A47F 1/126 211/59.3
9,101,230 B2 * 8/2015 Sosso ..... A47F 1/126
9,392,885 B2 * 7/2016 Vogler ..... A47F 1/126
9,445,675 B1 * 9/2016 DeSena ..... A47F 1/126
2006/0186065 A1 * 8/2006 Ciesick ..... A47F 1/04 211/59.3
2007/0170127 A1 * 7/2007 Johnson ..... A47F 1/126 211/59.3
2010/0012602 A1 * 1/2010 Valiulis ..... A47F 1/126 211/59.3

(Continued)

*Primary Examiner* — Leslie A Nicholson, III
*Assistant Examiner* — Kimberley S Wright
(74) *Attorney, Agent, or Firm* — Richard A. Fagin

(57) ABSTRACT

A retail product display unit in one aspect includes a pusher disposed on a pusher rail. The pusher has features to constrain movement of the pusher along a length of the pusher rail. The pusher rail extends from a forward end of the display unit to a rear end of the display unit. The at least one pusher rail comprises a channel in an upper surface thereof for receiving a pusher spring therein as the at least one pusher is moved from the forward end toward the rear end of the display unit. In another aspect, the pusher has at least one roller mounted to a pusher housing opposite the pusher face such that torque generated by application of rearward force applied to the pusher face is transferred to the at least one roller and then to the pusher rail.

12 Claims, 13 Drawing Sheets

(56) References Cited

U.S. PATENT DOCUMENTS

| | | | | |
|---|---|---|---|---|
| 2011/0210086 | A1* | 9/2011 | Ciesick | A47F 1/126 211/59.3 |
| 2012/0204458 | A1* | 8/2012 | Goehring | A47F 1/12 40/642.02 |
| 2013/0112634 | A1* | 5/2013 | Nagel | A47B 96/027 211/59.3 |
| 2013/0206713 | A1* | 8/2013 | Hardy | A47F 1/126 211/59.3 |
| 2013/0240467 | A1* | 9/2013 | Ciesick | A47F 1/04 211/59.3 |
| 2014/0190914 | A1* | 7/2014 | Nagel | A47B 96/027 211/59.3 |
| 2014/0319086 | A1* | 10/2014 | Sosso | A47F 1/126 211/59.3 |
| 2015/0083744 | A1* | 3/2015 | Vogler | A47F 1/126 221/154 |
| 2015/0164241 | A1* | 6/2015 | Nagel | A47F 1/125 211/59.3 |
| 2015/0208830 | A1* | 7/2015 | Hardy | A47F 1/126 211/59.3 |
| 2015/0230628 | A1* | 8/2015 | Juric | A47F 5/005 211/59.2 |
| 2015/0257547 | A1* | 9/2015 | Nagel | A47F 3/147 211/59.3 |
| 2015/0289680 | A1* | 10/2015 | Sosso | A47F 1/125 29/428 |
| 2016/0081491 | A1* | 3/2016 | Hardy | A47F 1/126 211/59.2 |

* cited by examiner

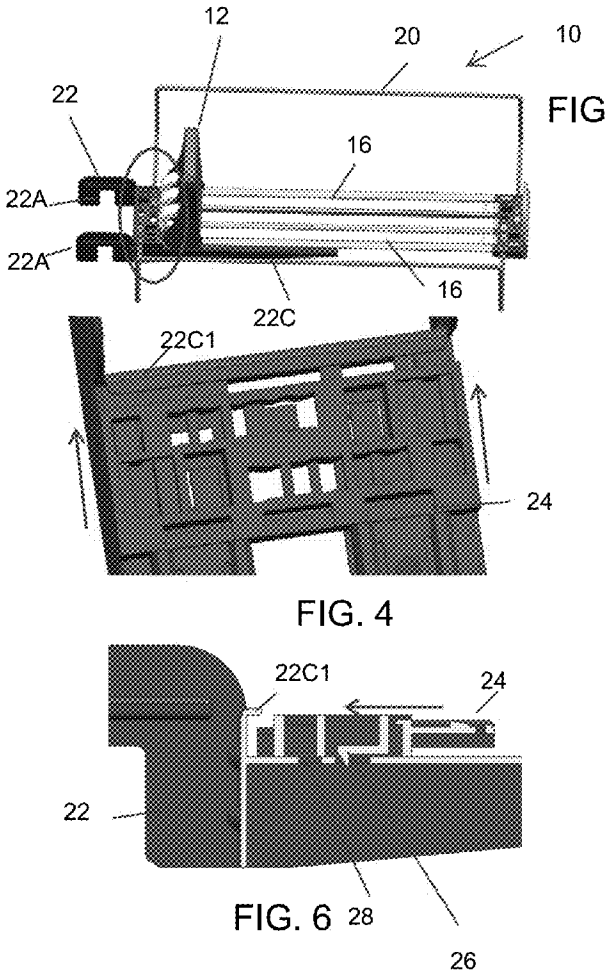
FIG. 3
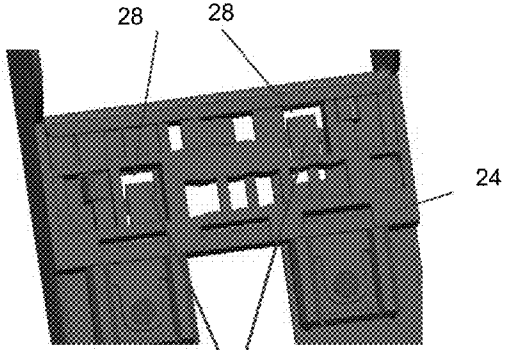
FIG. 5
FIG. 4
FIG. 6
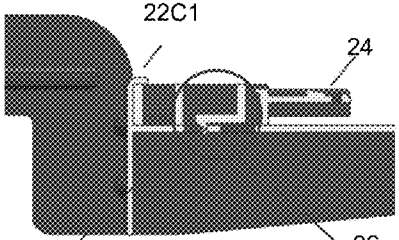
FIG. 7

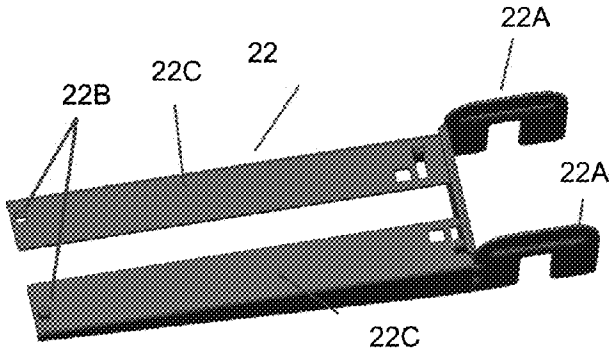
FIG. 16
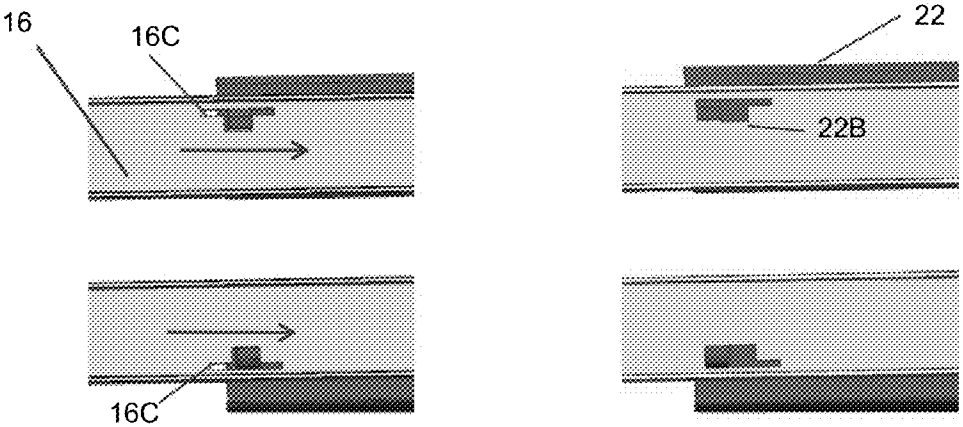
FIG. 17
FIG. 18

MODULAR RETAIL PRODUCT DISPLAY UNIT WITH IMPROVED PUSHER

CROSS REFERENCE TO RELATED APPLICATIONS

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of retail product display units. More specifically, the disclosure relates to retail product display units having a pusher to urge product packages loaded thereon toward a forward end of the display unit. The present disclosure further relates to product displays that may be assembled in different configurations depending on the specific needs of the user. The disclosure further relates to improved function pushers for such display units.

Retail product displays comprise pusher operated display units. One example of a pusher operate retail product display unit is described in U.S. Pat. No. 7,823,874 issued to Hardy. Such display units comprise one or more product "lanes" in which product containers are confined to a space that enables the product packages to be arranged in one or more lines extending from a rearwardmost product package to a barrier at a front end of the lane which restricts the packages from moving forward beyond the barrier. A pusher is coupled by a biasing device such as a flat coil spring so as to urge the pusher toward the barrier. The pusher thus maintains contact with the rearwardmost product package in a lane and as product packages are removed by consumers from the lane the pusher maintains forward biasing on the remaining product packages. Thus the forwardmost package remaining in the lane is urged into contact with the barrier for ready removal by a consumer or a merchandiser.

Pusher type retail product display units are generally assembled to at least the lane level prior to shipment to a user of such displays. Further, the product display units may be configurable for only one type of product package or one size of product package.

During replenishing product packages in a lane, the user may urge the pusher by hand toward the back of the product display unit and then load additional product packages in the space between the reardwardmost package remaining on the display unit. Such hand operation of the pusher may be difficult because force is applied to the upper end of the pusher face as a practical matter, and such force applied to the pusher tends to cause the pusher to frictionally engage the bottom of the product lane. Such frictional engagement may make moving the pusher difficult for the user.

BRIEF DESCRIPTION OF THE DRAWINGS

FIG. 3 shows an oblique view of the product display unit in FIG. 1 illustrating one type of attachment device for the unit to attach the unit to a display case.

FIGS. 4 through 7 show an example embodiment of a rearward end cap for the display unit having features to make locking connection to the attachment device.

FIG. 16 shows one example embodiment of a display unit attachment device.

FIGS. 17 and 18 show one embodiment of a locking device to secure pusher rails on the display unit to the attachment device.

DETAILED DESCRIPTION

Figure 1:
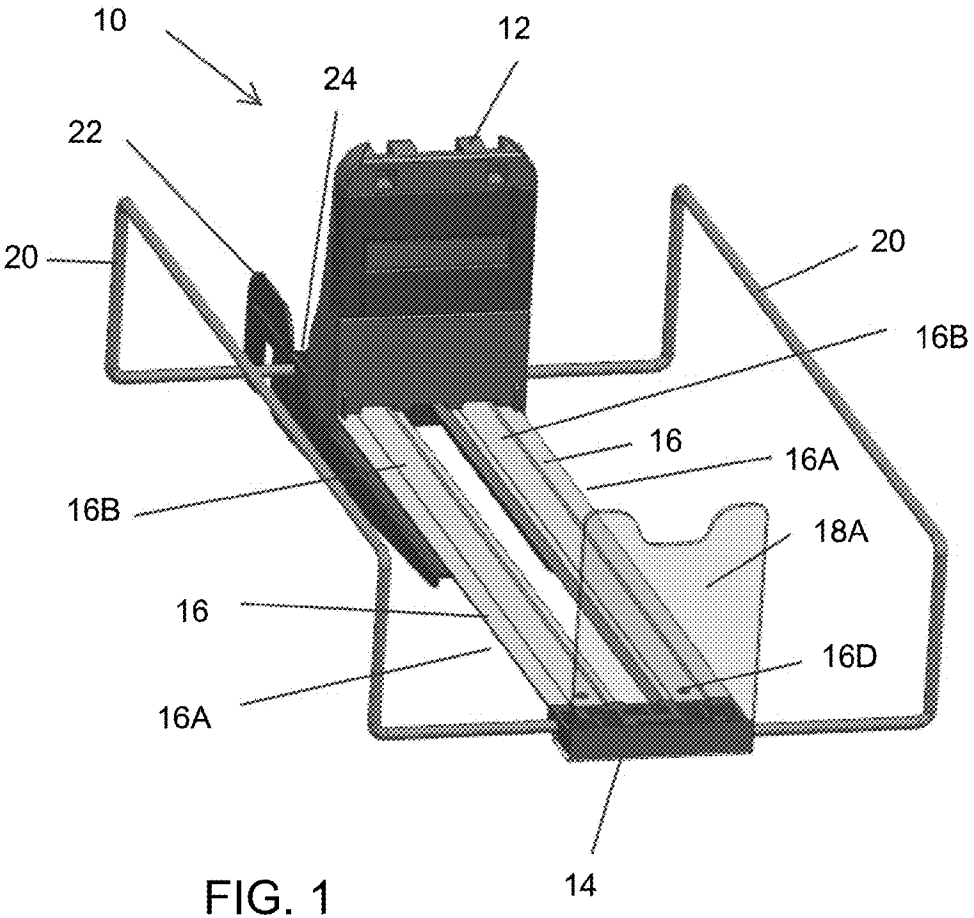
FIG. 1 shows an example embodiment of a retail product display unit according to the present disclosure.

FIG. 1 shows an example embodiment of a retail product display unit 10 according to the present disclosure. The product display unit 10 shown in FIG. 1 may be for a single lane of product packages. In any installation of the product display unit 10 shown in FIG. 1, a plurality of such display units may be mounted side by side and vertically within any display case or shelf to provide multiple product lanes within the display case or shelf. Certain features of a product display unit according to the present disclosure may enable the same basic structure to be used with different sizes of product packages and may be assembled in different configurations using substantially identical basic components.

The example embodiment shown in FIG. 1 may comprise a display base including at least one and in some embodiments two or more pusher rails 16 that extend between a front end cap 14 and a rear end cap 24. In the present example embodiment, the pusher rails 16 may be made from extruded aluminium, although it will be appreciated that other materials may be used for the pusher rails. A front barrier 14A may be coupled to the forward end cap 14 as will be further explained below with reference to FIGS. 8 through 11. The front barrier 18A in the present embodiment may be made from a clear plastic to enable a user or consumer to view most of the forwardmost package (not shown) on the display unit 10.

In the present embodiment, laterally extensible lane dividers 20 may be engaged with the front end cap 14 and the rear end cap 24 so that a width of a product lane defined by the lane dividers 20 may be adjusted by the user to correspond to the width of the particular product packaging being stored on the display unit 10.

In the present embodiment, the display unit 10 may be affixed to an attachment device 22. In the present embodiment, the attachment device may be a hook supported shelf base of types known in the art. Hooks (22A in FIG. 3) may engage a slotted rack (not shown) affixed to a rear wall of a display case (not shown for clarity of the illustration), for example, a refrigerated display case to support the display unit 10 in a desired position within the display case (not shown). A pusher 12 may provide biasing force to urge product packages on the product display unit 10 toward the front barrier 18A. The pusher 12 may comprise one or more biasing elements such as flat coiled springs (see FIG. 37) to urge the pusher 12 toward the front barrier 18A. The one or more pusher rails 16 may include laterally outward facing features 16A such as a flange that may engage corresponding features (see FIGS. 36 and 37) in the pusher 12 to constrain movement of the pusher 12 in a line extending between the front barrier 18A and the rear end cap 24. The one or more pusher rails 16 may comprise a channel 16B in an upper surface thereof so that a pusher spring (see FIG. 38) may be disposed in the channel 16 to avoid interference with movement or product packages in the display unit 10.

Figure 2:
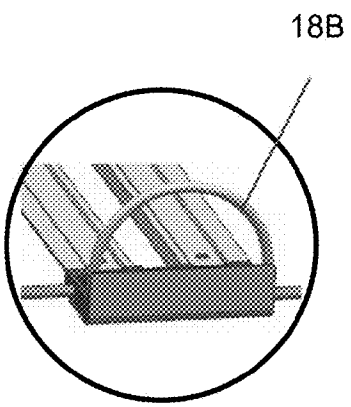
FIG. 2 shows an inset view of the example embodiment of FIG. 1 wherein a different embodiment of a front barrier is used.
Figure 15:
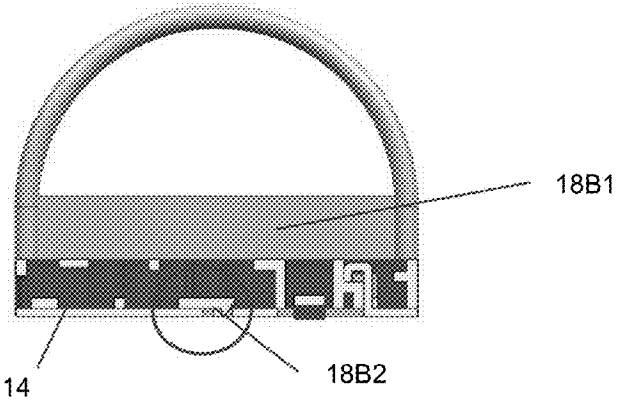
Figure 12:
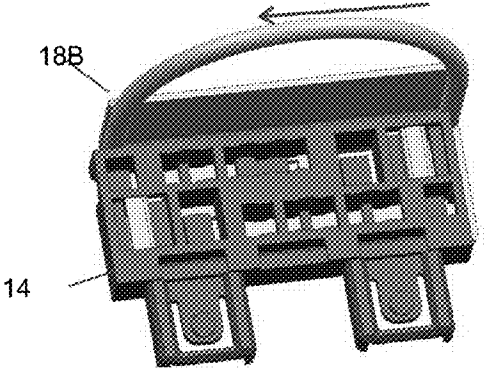
Figure 13:
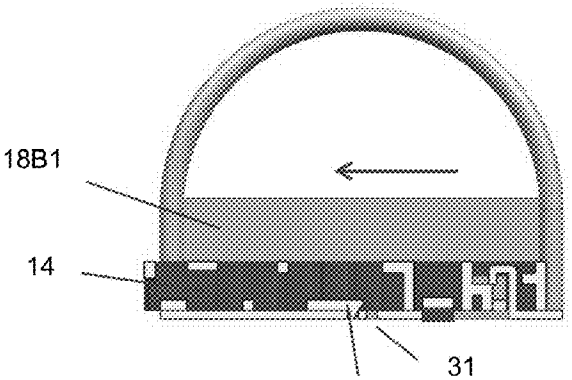
Figure 21:
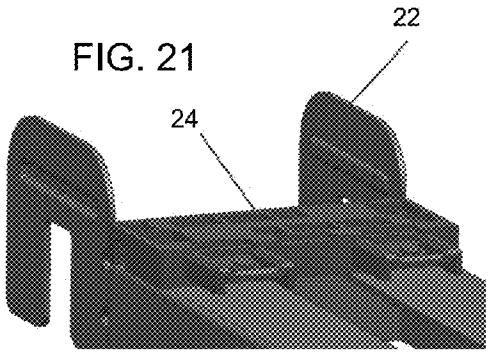
FIGS. 19 through 22 show assembly of the rear end cap to the attachment device in more detail to illustrate example locking features.
Figure 22:
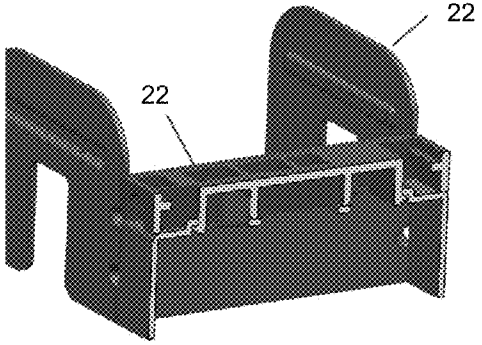
Figure 19:
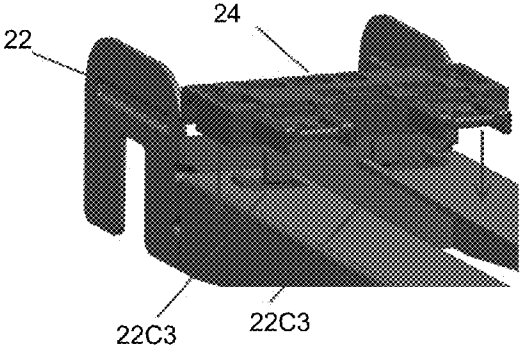
Figure 20:
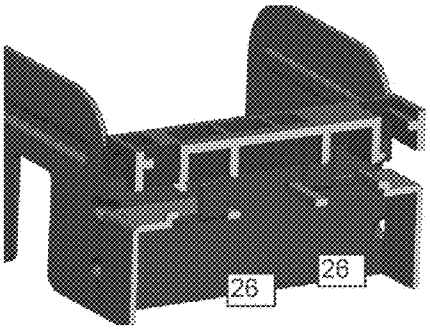

FIG. 2 shows an inset view of the example embodiment of FIG. 1 wherein a different embodiment of a front barrier is used. In the example embodiment of FIG. 2, the front barrier 18B may be a shaped wire coupled to a barrier mount (see FIGS. 13 and 15) that may lockably engage the forward end cap (14 in FIG. 1).

FIG. 3 shows an oblique view of the product display unit in FIG. 1 illustrating one type of attachment device 22 for the display unit 10 to attach the unit to a display case (not shown). In the present example embodiment, the attachment device 22 may comprise laterally spaced apart hooks 22A that are engageable with a slotted shelf support of types well known in the art. The attachment device 22 may include one or more display supports 22C that extend longitudinally toward the forward end cap (14 in FIG. 1) and are connected to bottom surfaces of the one or more pusher rails 16 using various devices as will be further explained below. The pusher 12 is shown in its rearwardmost position (i.e., pushed to the back of the display unit 10).

FIGS. 4 through 7 show bottom views (FIGS. 4 and 5) and side views (FIGS. 6 and 7) of an example embodiment of the rearward end cap 24 for the display unit having features to make locking connection to the attachment device 22. In the present example embodiment, the display supports 22C forming part of the attachment device 22 may have proximate their rearwardmost extent a channel 22C1 that may receive a mating part of the rear end cap 24. Locking apertures 26 may be formed in each of the display supports 24 such that a corresponding locking tab 28 on each rear end cap 24 may lockingly engage the locking aperture 26 when the rear end cap 24 is fully engaged with the channel 22C1.

Figure 9:
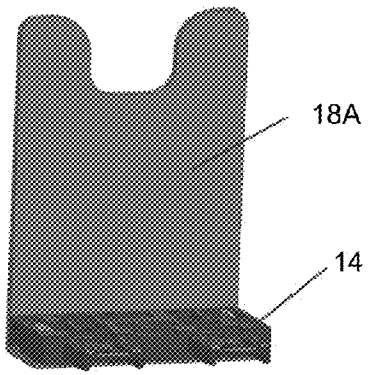
FIGS. 8 through 11 show a more detailed view of assembly of a front barrier as in FIG. 1 to a forward end cap of the display unit.
Figure 8:
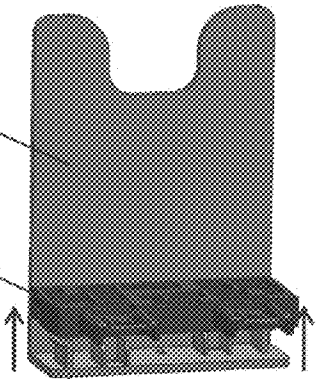
Figure 11:
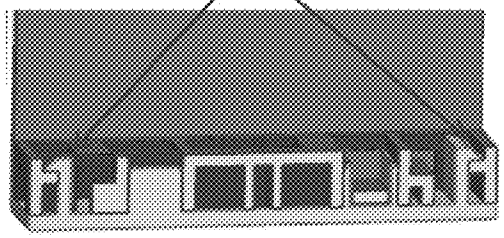
Figure 10:
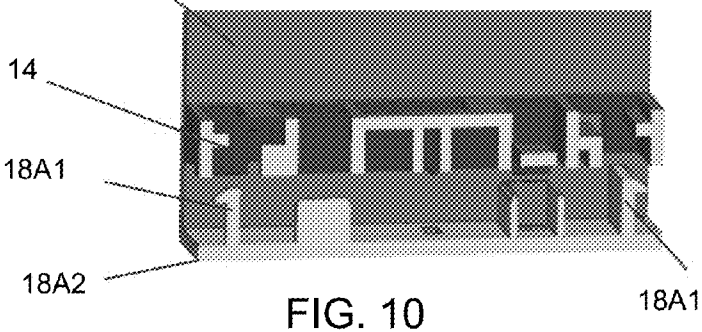
Figure 14:
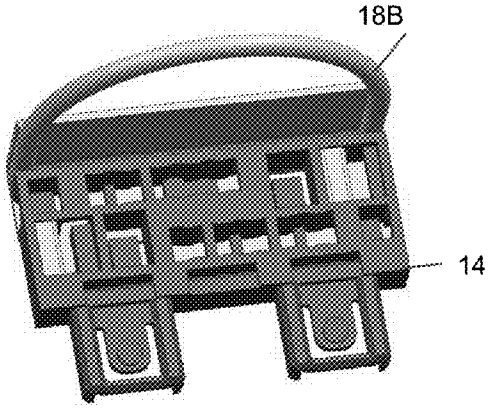
FIGS. 12 through 15 show a more detailed view of the front barrier of FIG. 2 to the forward end cap.

FIGS. 8 through 11 show a more detailed view of assembly of a front barrier as in FIG. 1 to a forward end cap of the display unit. In FIG. 8, part of the forward end cap 14 is shown raised above a basal mounting surface 18A1 of the front barrier 18A of FIG. 1. The basal mounting surface 18A1 may be perpendicular or at any other selected angle with reference to the front barrier 18A and may be formed therewith as a single component. FIG. 9 shows the forward end cap 14 pressed onto the basal mounting surface 18A1. FIG. 10 shows locking tabs 18A2 formed into the basal mounting surface 18A1 that project upwardly and pass through corresponding openings (30 in FIG. 11) when the forward end cap 14 is pressed onto the basal mounting surface 18A1. It will be appreciated that the material used to make the front barrier 18A may be a semi-resilient plastic such that the locking tabs 18A2 may be deflected to enable passage through the corresponding openings 30 and when fully passed therethrough may return to their unstressed state so that the locking tabs 18A2 engage a surface at an end of a corresponding opening 30, thus locking the front barrier 18A to the forward end cap 14.

FIGS. 12 through 15 show a more detailed view of the front barrier 18B of FIG. 2 to the forward end cap. The front barrier 18B may comprise a wire half-loop as shown in the figures coupled to a mounting plate 18B1. The mounting plate 18B1 may comprise one or more locking tabs 18B2 that engage corresponding openings 31 in the forward end cap 14. In the embodiment shown in FIGS. 12 through 15, the front barrier 18B may be affixed to the forward end cap 14 by moving the front barrier 18B transversely with respect to an end of the forward end cap 14 to as to engage the locking tabs 18B2 with the corresponding openings 31.

In the foregoing two embodiments of the front barrier shown in FIGS. 8 through 15, the forward end cap 14 may have the same structure so that either type of front barrier may be used with the product display according to the present disclosure. It will be appreciated that other configurations for the front barrier may be devised within the scope of the present disclosure which provide similar interchangeability as the embodiments explained above with reference to FIGS. 8 through 15.

FIG. 16 shows one example embodiment of a display unit attachment device 22 having features 22B to secure the pusher rails (FIGS. 17, 18) to the display supports 22C. In the present example embodiment, the securing features 22B may be slotted tabs that protrude upwardly and then are folded into a plane substantially parallel with a plane of each of the display supports 22C.

FIGS. 17 and 18 show the slotted tabs 22B inserted through openings 16C such as slots in the bottom surface of the pusher rails 16. When the pusher rails 16 are moved rearwardly relative to the display supports 22C, the slotted tabs 22B engage the end of the respective slot 16C to secure the pusher rails 16 on the display unit to the attachment device (22 in FIG. 16). FIG. 17 shows the assembly prior to movement of the rails 16 relative to the attachment device. FIG. 18 shows the assembly after movement as explained to lock the pusher rails 16 to the attachment device 22.

FIGS. 19 through 22 show another embodiment of assembly of the rear end cap 24 to the attachment device 22 in more detail to illustrate example locking features. In the present example embodiment, the attachment device 22 may omit the channel (22C1 in FIGS. 4 through 7) and have therein openings 22C3 that engage locking tabs 26 formed onto the bottom of the rear end cap 24. Thus the rear end cap 24 may be secured to the attachment device 22 by simply pushing the rear end cap 24 downward when the locking tabs 26 are disposed over the openings 22C3.

Figure 23:
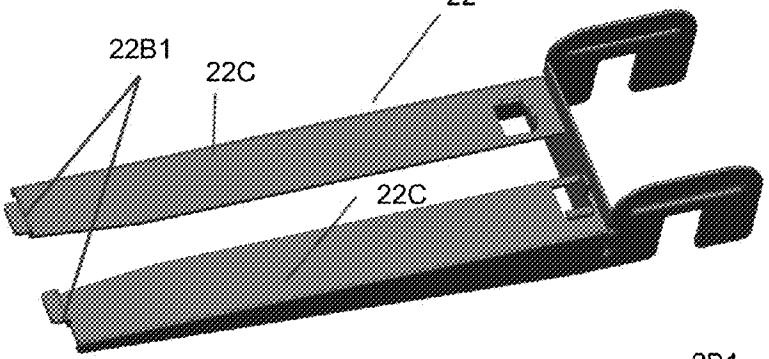
FIGS. 23 through 25 show a different example embodiment of an attachment device and features to secure the attachment device to the pusher rails in the display unit.
Figure 24:
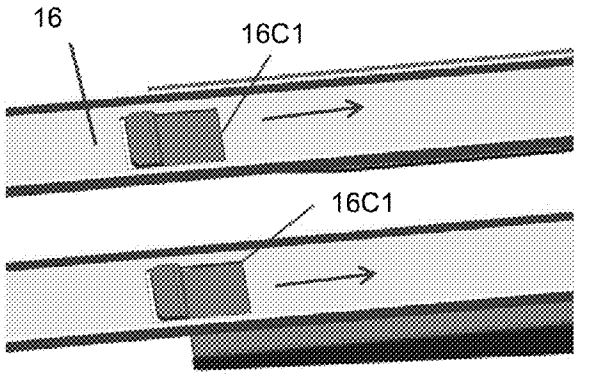
Figure 25:
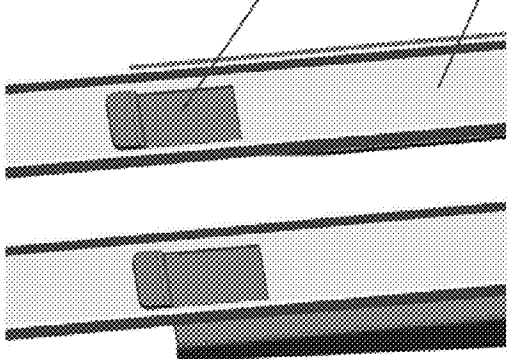

FIGS. 23 through 25 show a different example embodiment of an attachment device and features to secure the attachment device to the pusher rails in the display unit. In the present example embodiment, the display supports 22C may include longitudinally projecting, raised tangs 22B1 that engage corresponding slots 16C1 formed in the bottom surface of each pusher rail 16. The tangs 22B1 may be locked into the slots 16C1 by moving the pusher rails 16 as shown relative to the attachment device 22.

Figure 27:
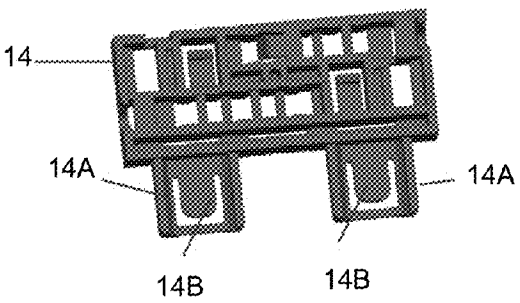
FIGS. 26-29 show oblique views, respectively, of the top and bottom of the front end cap and the rear end cap to illustrate locking features to secure the end caps to pusher rails.
Figure 26:
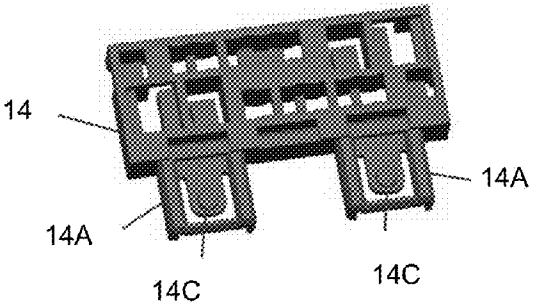
Figure 29:
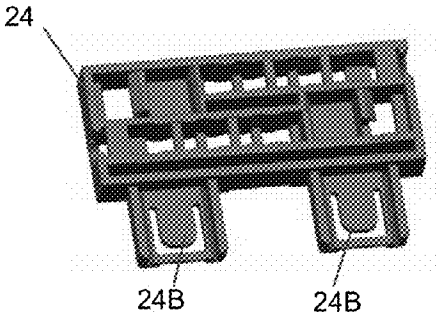
Figure 28:
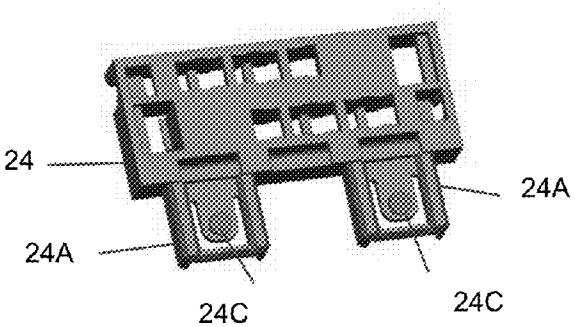

FIGS. 26-29 show oblique views, respectively, of the top and bottom of the forward end cap 14 and the rear end cap 24 to illustrate locking features to secure the end caps to the pusher rails (16 in FIG. 1). In FIGS. 26 and 27, the forward end cap 14 may include a channel 14A to engage the lateral edges of each pusher rail (16 in FIG. 1. A locking button 14C may extend vertically from a locking tang 14B such that when the pusher rail (16 in FIG. 1) is inserted into the channel 14A, the locking tang 14B is deflected until an aperture (16D in FIG. 1) is positioned above the locking button. If made from suitably semi resilient material such as other locking tabs and similar features described elsewhere herein, the locking tang 14B will urge the locking button 14C through the aperture (16D in FIG. 1) in the pusher rail (16 in FIG. 1) thus locking the pusher rail into the forward end cap. Corresponding features 24A, 24B, 24C may be provided for the rear end cap as shown in FIGS. 28 and 29.

Figure 30:
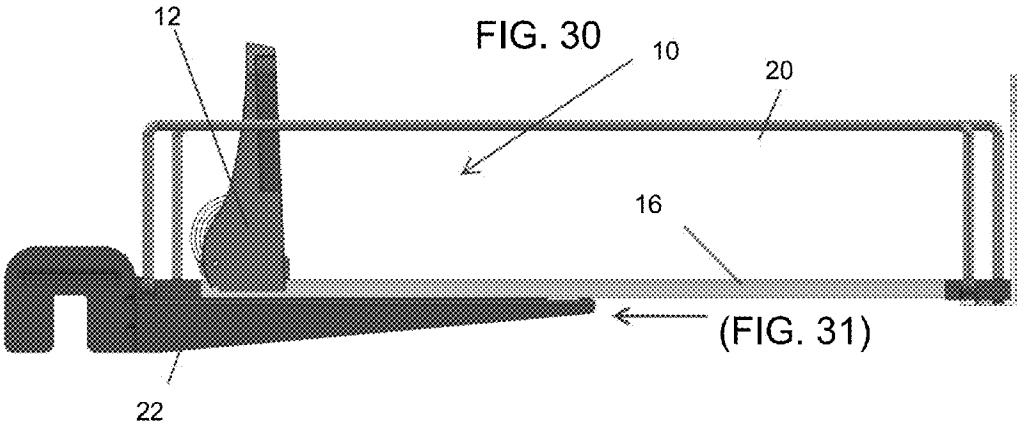
FIGS. 30 and 31 show, respectively a side elevation and a cross section transverse to the side elevation of a product display unit mounted to an attachment device to illustrate one example embodiment of mounting the display unit to the attachment device.
Figure 31:
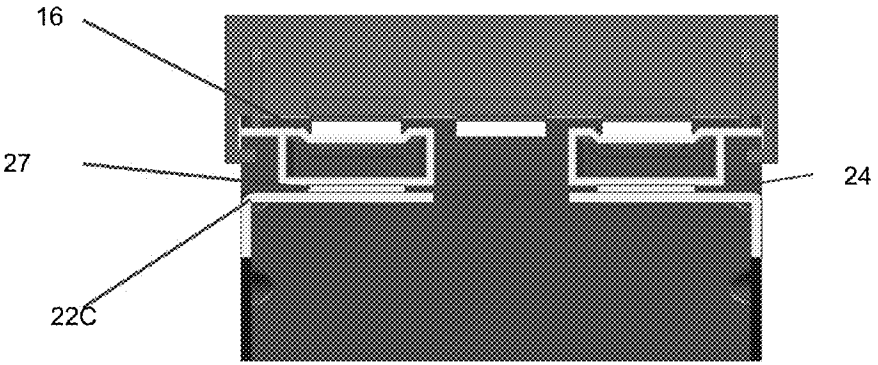

FIGS. 30 and 31 show, respectively a side elevation and a cross section transverse to the side elevation of a product display unit 10 mounted to an attachment device 11 to illustrate one example embodiment of mounting the display unit 10 to the attachment device 22. In FIG. 31, a bottom surface of the pusher rail 16 may comprise a segment of adhesively bonded permanent magnet strip 27 such as magnet tape affixed thereto. The magnet strip 27 may magnetically attract and thus be retained onto the display support 22C if the display support is made from suitable ferromagnetic material such as steel.

Figure 32:
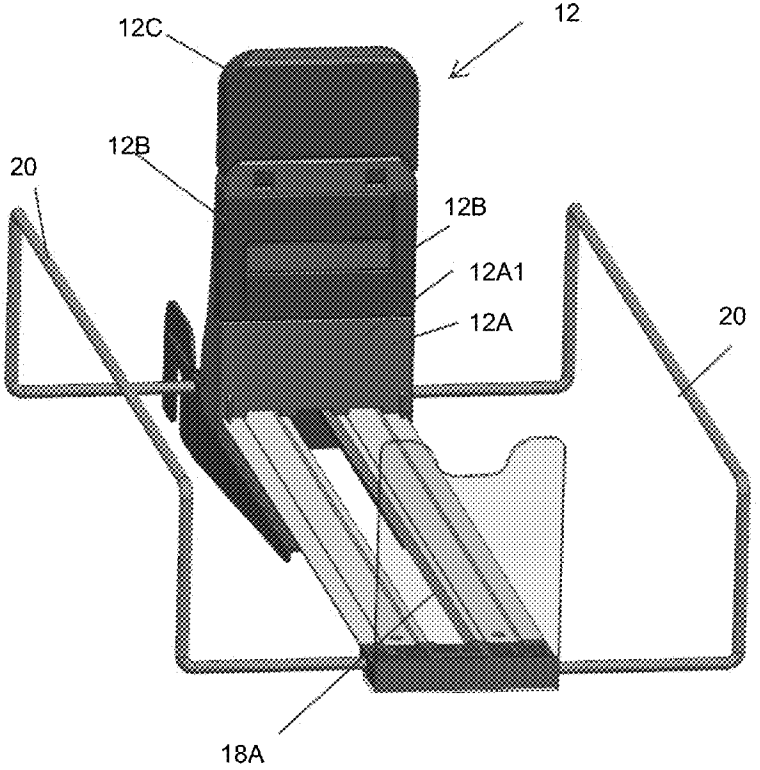
FIG. 32 shows the example embodiment of FIG. 1 to illustrate one example embodiment of a pusher according to the present disclosure.
Figure 33:
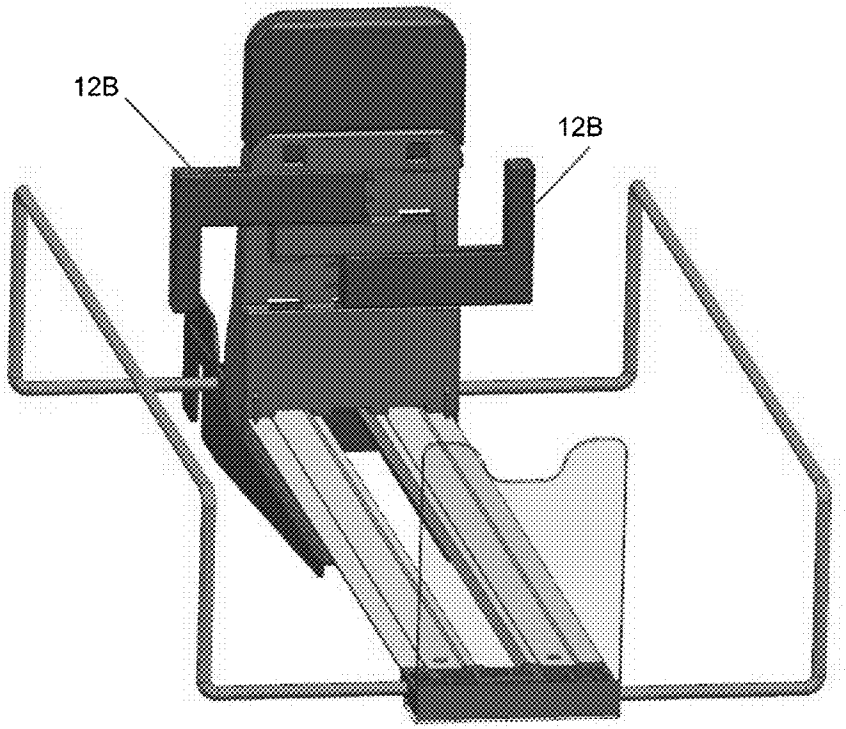
FIG. 33 shows the example embodiment of FIG. 32 in which paddles on the pusher are extended to increase the support surface area of the pusher face in a lateral direction.

FIG. 32 shows a variation of the example embodiment of FIG. 1 to illustrate one example embodiment of a pusher according to the present disclosure. The pusher 12 may comprise a pusher housing 12A, some details of which will be explained with reference to FIGS. 37 and 38 below. The pusher housing 12A has a pusher face 12A1 on the side of the pusher housing 12 that is intended to contact the rearwardmost product package on a product lane (in the present example defined between adjustable wire dividers 20). The pusher face 12A1 may have inserted therein one or more laterally extensible paddles 12B. The paddles 12B are shown in a retracted position in FIG. 32. The pusher housing 12A may comprise a pusher face extension 12C that may be attached to a top end of the pusher face 12A1. In some embodiments, the pusher face extension 12C may be omitted. In the present example, the front barrier 18A may be the one shown in and explained with reference to FIG. 1, however, any other front barrier configuration may be used on other embodiments. FIG. 33 shows the example embodiment of FIG. 32 in which the paddles 12B on the pusher face 12A1 are extended to increase the support surface area of the pusher face 12A1 in a lateral direction. The paddles 12B may be constrained to move only laterally, such as by using guide rails or any similar feature on both the paddles 12B and the pusher face 12A1. The type of features used to constrain movement of the paddles 12B is not a limit on the scope of the present disclosure.

Figure 36:
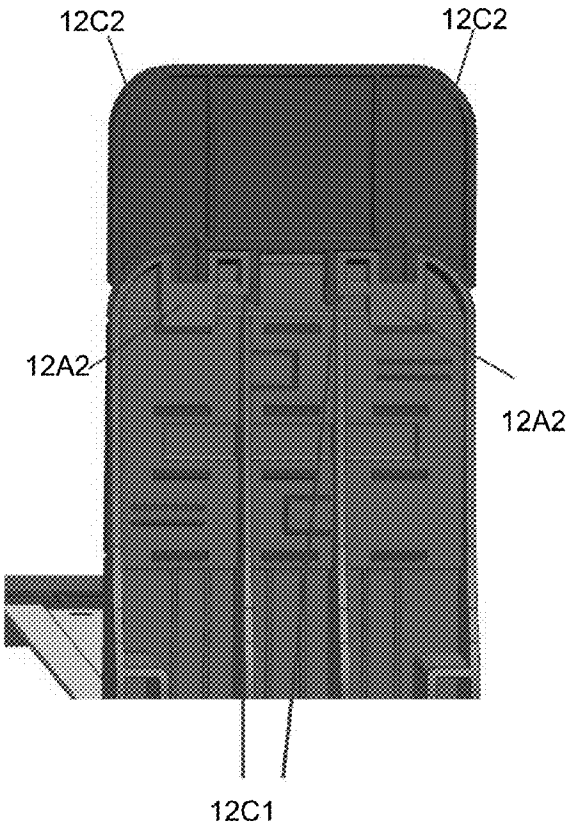
FIGS. 34 through 36 show an extension plate that may be affixed to the pusher of FIG. 32 to extend the support area of the pusher face in a vertical direction.
Figure 35:
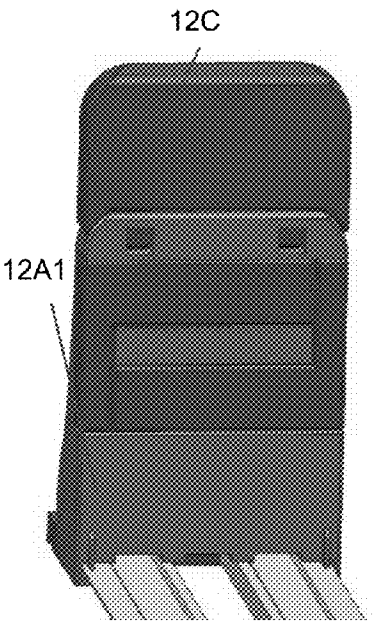
Figure 34:
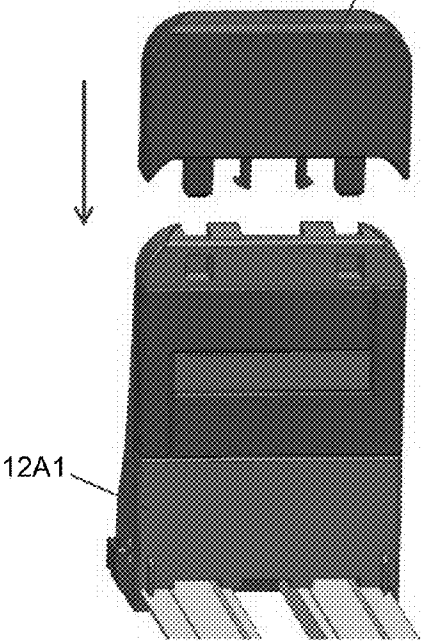

FIGS. 34 through 36 show the pusher face extension 12C that may be affixed to the pusher face 12A1 of FIG. 32 to extend the support area of the pusher face 12A1 in a vertical direction. FIG. 34 shows the pusher face extension 12C suspended above the pusher face 12A1 for insertion therein. FIG. 35 shows the pusher face extension 12C assembled to the pusher face 12A1. FIG. 36 shows one example embodiment of features that may be used to lock the pusher face extension 12C to the pusher face 12A. Guide pins 12C2 may be formed into or otherwise affixed to the bottom of the pusher face extension 12C. The guide pins 12C2 cooperatively engage openings 12A2 formed in or attached to the back side of the pusher face 12A1. The guide pins 12C2 may provide additional strength to the assembled pusher face extension 12C and pusher face 12A1. The pusher face extension 12C may be locked into place in the pusher face 12A1 by locking tabs 12C1 that cooperatively engage locking surfaces 12A2 on the back of the pusher face 12A1. As with any or all the other implementations of locking tabs described herein, the locking tabs 12C2 on the pusher face extension may be formed from semi resilient plastic such that movement of the locking tabs 12C2 against the cooperative surfaces 12A2 deflects the locking tabs 12C2 until they have moved past the respective cooperative locking surface 12A2, whereupon the locking tabs 12C2 return to their unstressed state to lock the pusher face extension 12C to the pusher face 12A1.

Figure 37:
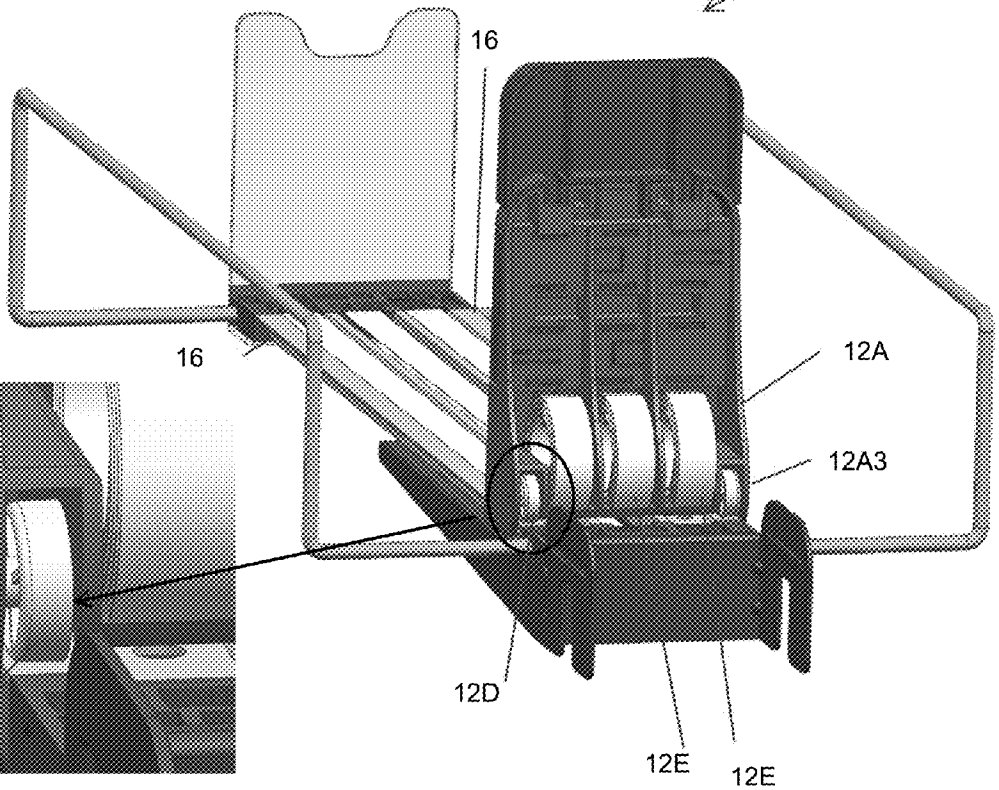
FIGS. 37 and 38 show an example embodiment of a pusher having rollers to reduce friction during product package loading onto the display unit of FIG. 1.
Figure 38:
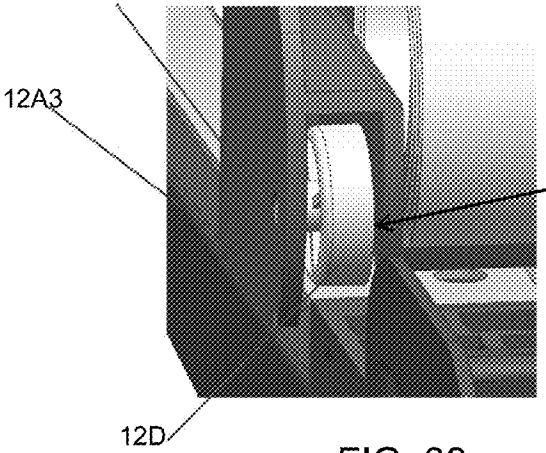

FIGS. 37 and 38 show an example embodiment of a pusher having rollers to reduce friction during product package loading onto the display unit of FIG. 1. The back of the pusher housing 12A is shown in FIG. 37 to illustrate placement of one or more flat coiled springs 12E that may be affixed at their forward ends to part of the display unit 10, e.g., the forward end cap (14 in FIG. 1), or the forward end of one or more of the pusher rails 16. When the pusher 12 is moved toward the back of the display unit 10 the spring(s) 12E unwind to provide forward biasing force on the pusher 12. Guide slots 12A3 formed in the sides of the housing 12A may cooperatively engage the edge of the one or more pusher rails 16 to constrain movement of the pusher 12 to along a line parallel to the pusher rails 16. In the present example embodiment, at least one roller or wheel 12D, and in the present example embodiment two rollers or wheels 12D may be rotatably affixed to the pusher housing 12A on opposite sides of the pusher housing 12A. One of the rollers or wheels 12D is shown in more detail in FIG. 38, wherein an axle 12D1 may rotatably support the roller or wheel 12D in the pusher housing 12A. When a user replenishes product packages on a product lane, the pusher 12 is typically moved rearward in the display unit 10 by hand. Hand pressure may be applied to the upper part of the pusher face (12A1 in FIG. 34 and FIG. 35). Such hand pressure has the effect of causing torque to be applied to the pusher 12 in addition to longitudinal force. The torque has the effect of causing increased friction between the guide slots 12A3 or any similar feature and the pusher rails 16 or any corresponding feature in other embodiments. Such increased friction may make rearward movement of the pusher 12 difficult for the user. In the present example embodiment, the torque is transferred to the one or more rollers or wheels 12D, so that friction is not substantially increased when moving the pusher rearward in the display unit 10 to replenish product packages in a product lane.

A product display unit according to the various aspects of the present disclosure may provide for ease of assembly at the point of use, thus making shipping the product display to the point of use more compact and economical. The product display unit may be reconfigured to accommodate various sizes or product packages, may be readily assembled to a wall or shelf in a display case and may provide for easier reloading of product containers on the product display unit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A retail product display unit, comprising:

at least one pusher disposed on a pusher rail, the pusher having features to constrain movement of the pusher to a direction along a length of the pusher rail, the pusher rail extending from a forward end of the display unit to a rear end of the display unit;

wherein the at least one pusher rail comprises a channel in an upper surface thereof for receiving a pusher spring therein as the at least one pusher is moved from the forward end toward the rear end of the display unit; and a forward end cap and a rear end cap coupled to longitudinal ends of the at least one pusher rail, the forward end cap and the rear end cap comprising a channel for receiving a respective longitudinal end of the at least one pusher rail, the forward end cap and the rear end cap each comprising a locking tang extending into a respective channel, the locking tang having a locking button extending from a surface thereof, each locking button cooperatively engaged with a corresponding aperture in the at least one pusher rail to lock the forward end cap and the rear end cap to the at least one pusher rail.

2. The retail product display unit of claim 1 further comprising at least one laterally extensible wire lane divider slidably engaged with the forward end cap and the rear end cap.

3. The retail product display unit of claim 1 further comprising locking features in the forward end cap to engage one of a plurality of different configurations of a forward barrier.

4. The retail product display unit of claim 1 wherein the rear end cap comprises at least one feature to lockingly engage a display unit attaching device.

5. The retail product display unit of claim 4 wherein the at least one feature on the rear end cap comprises a lateral channel formed in a rearward end of display supports extending from display unit attaching hooks and a mating feature on the rear end cap to engage the lateral channel when the rear end cap is moved toward the lateral channel.

6. The retail product display unit of claim 1 further comprising at least one roller rotatably mounted to a pusher housing on a side opposite a pusher face, the at least one roller cooperatively engaged with the at least one pusher rail such that torque generated by application of rearward force applied to a pusher face is transferred to the at least one roller.

7. The retail product display unit of claim 1 wherein the at least one pusher comprises a pusher face having an adjustable pusher face area.

8. A retail product display unit, comprising:

at least one pusher rail;

a pusher cooperatively engaged with the at least one pusher rail, the pusher comprising a biasing device to urge the pusher toward a front end of the at least one pusher rail;

wherein the pusher comprises at least one roller rotatably mounted to a pusher housing on a side opposite a pusher face, the at least one roller cooperatively engaged with the at least one pusher rail such that torque generated by application of rearward force applied to the pusher face is transferred to the at least one roller; and a forward end cap to a rear end cap coupled to longitudinal ends of the at least one pusher rail, the forward end cap and the rear end cap comprising a channel for receiving a respective longitudinal end of the at least one pusher rail, the forward end cap and the rear end cap each comprising a locking tang extending into a respective channel, the locking tang having a locking button extending from a surface thereof, each locking button cooperatively engaged with a corresponding aperture in the at least one pusher rail to lock the forward end cap and the rear end cap to the at least one pusher rail.

9. The retail product display unit of claim 8 further comprising at least one laterally extensible wire lane divider slidably engaged with the forward end cap and the rear end cap.

10. The retail product display unit of claim 8 further comprising locking features in the forward end cap to engage one of a plurality of different configurations of a forward barrier.

11. The retail product display unit of claim 8 wherein the at least one pusher comprises a pusher face having an adjustable pusher face area.

12. The retail product display unit of claim 8 wherein the biasing devices comprises a flat coiled spring and further comprising a channel in an upper surface of the at least one pusher rail for receiving the spring therein as the at least one pusher is moved from the forward end toward the rear end of the display unit.

* * * * *